United States Patent [19]

Holz et al.

[11] Patent Number: 4,613,854

[45] Date of Patent: Sep. 23, 1986

[54] SYSTEM FOR OPERATING A DOT MATRIX DISPLAY PANEL TO PREVENT CROSSTALK

[75] Inventors: George E. Holz, North Plainfield; James A. Ogle, Neshanic Station, both of N.J.

[73] Assignee: Burroughs Corporation, Detroit, Mich.

[21] Appl. No.: 524,872

[22] Filed: Aug. 22, 1983

[51] Int. Cl.[4] ..... G09G 3/00

[52] U.S. Cl. ..... 340/714; 340/776; 340/805

[58] Field of Search ..... 340/714, 758, 776, 805, 340/813; 315/169.1, 169.2, 169.4

[56] References Cited

U.S. PATENT DOCUMENTS

| | | | |
|---|---|---|---|
| 4,104,563 | 8/1978 | Schlig et al. | 340/805 |
| 4,302,756 | 11/1981 | Frankland | 340/776 |
| 4,315,259 | 2/1982 | McKee et al. | 340/799 |
| 4,328,489 | 5/1982 | Ngo | 340/805 |
| 4,329,616 | 5/1982 | Holz et al. | 340/714 |
| 4,373,157 | 2/1983 | Holz et al. | 340/805 |
| 4,386,348 | 5/1983 | Holz et al. | 340/714 |

*Primary Examiner*—Gerald L. Brigance
*Assistant Examiner*—Jeffery A. Brier
*Attorney, Agent, or Firm*—Mark T. Starr; Kevin R. Peterson

[57] ABSTRACT

The disclosure is of a system for operating a dot matrix display panel including elongated anodes and cathodes oriented transversely to each other to define columns of D.C. scanning cells. An array of quasi A.C. display cells is provided spaced from the D.C. scan cells by an apertured electrode plate. Operation of the D.C. scan cells to transfer glow from a scan cell to an associated display cell is achieved by momentarily turning off the scan cell by the application of a negative pulse to its anode. To prevent the coupling of this pulse to adjacent anodes and spurious operation of adjacent scan cells and display cells, a counter-balancing positive pulse is applied to all anodes and a counter-balancing negative pulse is applied to all "off" cathodes.

13 Claims, 4 Drawing Figures

140
114
110
120
100
30
132
94
142
86
10
92
88
150
80
2
50
40
50
74
61
22
74
61
60
70
64
60D
60C
60B
60A
62
50
2
40
20
160

SYSTEM FOR OPERATING A DOT MATRIX DISPLAY PANEL TO PREVENT CROSSTALK

BACKGROUND OF THE INVENTION

A new type of dot matrix gas discharge display panel having memory comprises a gas-filled envelope including a layer of D.C. scan/address cells and a layer of quasi A.C. display cells. The scan cells are scanned and turned on column-by-column by operation of their electrodes, and the same electrodes are used to transfer information from selected scan cells to the associated display cells where glow can be sustained so that the cells which are energized in the entire panel display a stationary but changeable message.

The electrical system for operating the panel and the panel itself are relatively complex; and, under some circumstances, crosstalk may occur, that is, unselected display cells may turn on when a selected display cell is turned on and glows. This is a problem especially in high density display panels, that is, display panels in which the cells and their electrodes are very close to each other or when panels are scanned and addressed at a high rate of speed.

U.S. Pat. No. 4,373,157 of George E. Holz and Okan K. Tezucar, incorporated herein by reference, describes one effective system for preventing crosstalk in a display panel of the type under consideration. The present invention provides additional control of this problem.

DESCRIPTION OF THE INVENTION

The present invention comprises an electronic system used with a display panel of the type described and claimed in copending application Ser. No. 051,313, filed June 22, 1979, by George E. Holz and James A. Ogle, and now U.S. Pat. No. 4,386,348 this patent being incorporated herein by reference along with the patents and articles cited therein.

Figure 1:
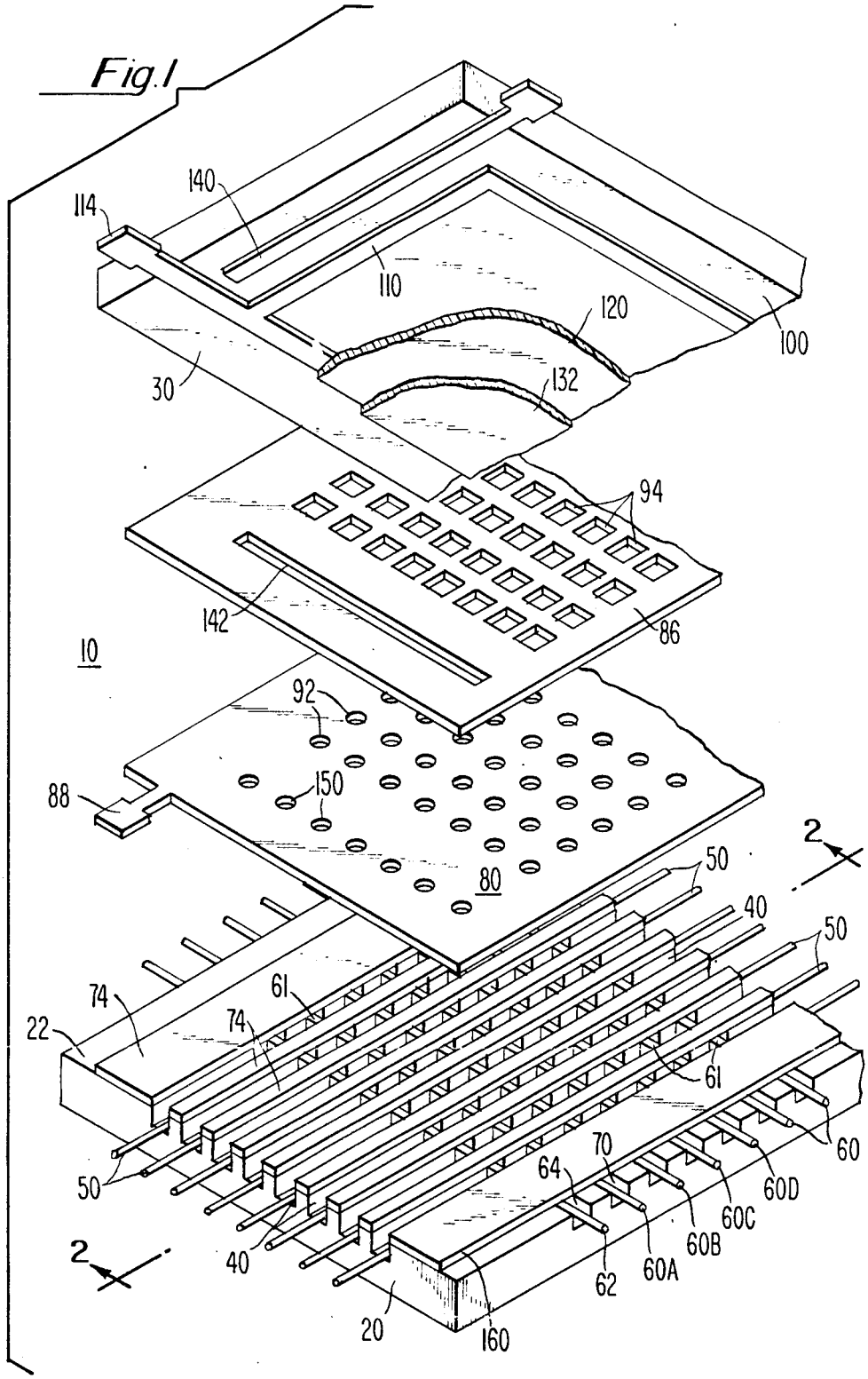
FIG. 1 is a perspective exploded view of a display panel operated according to the invention.

This display panel 10, shown in the drawings, comprises a gas-filled envelope made up of an insulating base plate 20 and a glass face plate 30, which is shown tilted up and to the left in FIG. 1 to present a view of its inner surface. These plates are hermetically sealed together along their aligned perimeters to provide an envelope which encloses the various gas-filled cells and operating electrodes of the panel. The base plate has a top surface 22 in which a plurality of deep parallel slots 40 are formed and in each of which a scan/address wire anode electrode 50 is seated and secured.

Figure 2:
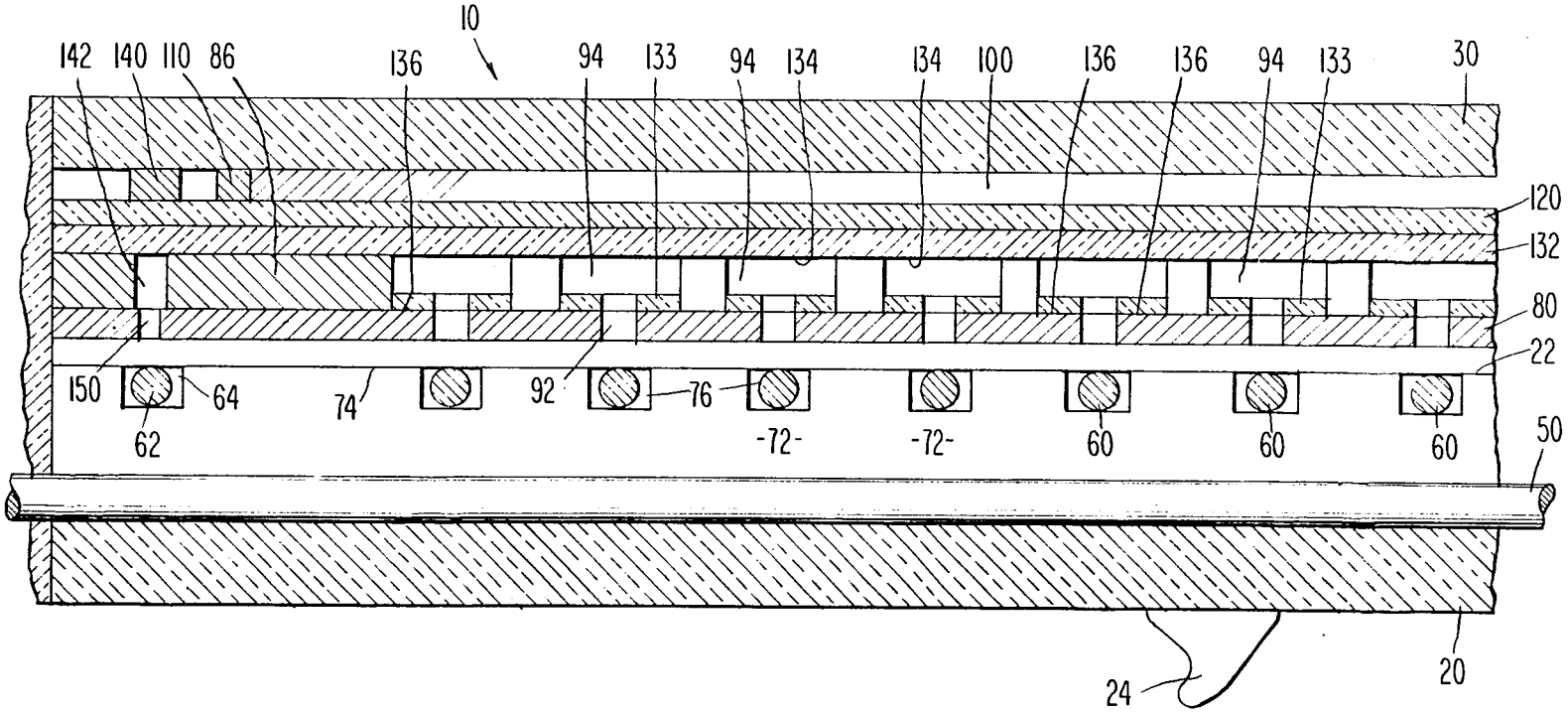
FIG. 2 is a sectional view through the panel of FIG. 1 along lines 2—2, with the panel shown assembled.

A plurality of scan cathode electrodes 60 are seated on the top surface of the base plate or in shallow grooves 70 therein. The grooves 70 and scan cathodes 60 are disposed transverse to the grooves 40 and scan anodes 50, and each crossing of a scan cathode 60 and scan anode 50 defines a scanning cell 72 (FIG. 2). It can be seen that the anodes 50 and cathodes 60 form a matrix of scanning cells which are arrayed in rows and columns. More specifically, the cathode portions 61, the underlying portions of anodes 50, and the intermediate gas volumes define the scanning cells.

The scan cathodes 60A, B, C, etc., form a series of cathodes which can be energized serially in a scanning cycle, with cathode 60A being the first cathode energized in the scanning cycle.

A reset cathode strip 62 is disposed on the base plate or in a groove 64 therein adjacent to the first scan cathode 60A, so that, when it is energized, it provides excited particles for cathode 60A at the beginning of a scanning cycle to be described. Where the reset cathode crosses each scan anode 50, a reset cell is formed, and the crossing of all of the scan anodes by the reset cathode provides a column of reset cells. These reset cells are turned on or energized at the beginning of each scanning cycle, and they expedite the turn-on of the first column of scanning cells associated with cathode 60A.

The panel 10 includes a keep-alive arrangement which is described below and in U.S. Pat. No. 4,329,616 of George E. Holz and James A. Ogle, which is incorporated herein by reference.

In the panel 10, a spacer means comprising strips 74 of insulating material, such as glass, are provided on the top surface of the insulating plate 20 between slots 40 and crossing cathodes 60 and 62 so that the cathodes are spaced uniformly from an electrode plate 80 (known as the priming plate) disposed above them, as described below. The strips 74 are disposed across the cathodes 60 which are thus separated into the discrete operating portions 61.

The portions of the panel described up to this point comprise the base plate assembly. This is the D.C. portion and the scanning and addressing portion of the panel 10 in which the electrodes are in contact with the gas in the panel.

Adjacent to the base plate assembly is the second portion of the panel which is a quasi A.C. assembly; that is, it includes electrodes which are insulated from the gas in the panel, and electrodes which are in contact with the gas. This portion of the panel includes electrode 80 which is in the form of the thin metal plate having an array of rows and columns of relatively small apertures 92, each overlying one of the scanning cells. The plate 80 is positioned close to cathodes 60 and may be seated on insulating strips 74. Plate 80 is known as a priming plate.

Adjacent to plate 80, and preferably in contact with the upper surface thereof, is an apertured plate 86 (known as the glow isolator) having rows and columns of apertures 94 which are larger than apertures 92. The apertures 94 comprise the display cells of panel 10. The sheet 86 may be of insulating material, or it may be of metal, and, if it is of metal, the plates 80 and 86 may be made in one piece. Plate 80 is provided with a tab 88 to which external electrical contact can be made.

The quasi A.C. assembly also includes a face plate assembly which includes a single large-area transparent conductive electrode 100 on the inner surface of the plate 30. A narrow conductor 110, which outlines and reinforces the electrode layer 100 in conductive contact, serves to increase its conductivity, if necessary. The conductor 110 includes a suitable tab 114, to which external connection can be made. The large-area electrode 100 is of sufficient area to overlie the entire array of display cells 94 in plate 86. An insulating coating 120 of glass or the like covers electrode 100, and this layer 120 is coated with a low work function refractory layer 132 of magnesium oxide, thorium oxide, or the like.

In panel 10, the apertures 94 in plate 86 comprise display cells, and, as can be seen in FIG. 2, each display cell has one end wall 134 formed by a portion of insulating layer 132, and an opposite end wall 136 formed by a portion of the top surface of plate 80. To provide cell uniformity and to minimize sputtering, a coating of the material of layer 132 should also be provided on the base or lower wall 136 of each display cell 94, such as the layer 133 shown in FIG. 2.

At the present time, it appears that optimum operation of the panel is achieved if the apertures or cells 94 are unsymmetrical in that insulating layers 120 and 132 together have a thickness greater than layer 133. Indeed, layer 133 may even be thinner than layer 132. Thus, the lower end wall 132 of each cell 94 will have a very high capacitance coupling to the cell, and layer 133 will consequently tend to form only a minimal wall charge in the operation described below. In one mode of construction, both layer 132 and layer 133 may be formed by an evaporation process, and layer 133 may be so thin that it is not completely continuous, which is a desirable quality. In any case, however, the character of this wall of the cell is affected by the aperture 92 in the metal plate 80.

The gas filling in panel 10 is preferably a Penning gas mixture of, for example, neon and a small percentage of xenon, at a pressure of about 400 Torr. When the panel has been constructed and evacuated, the gas filling is introduced through a tubulation 24 secured to base plate 20 (FIG. 2), or a non-tabulated construction can be employed.

The keep-alive arrangement, in panel 10, includes an A.C. electrode 140 in the form of a line-like conductive film or layer of an opaque metal, such as silver, provided on the inner surface of the face plate 30 adjacent to one edge of the transparent conductive electrode 100. The A.C. keep-alive electrode 140 is positioned so that, in the completed panel, it overlies the column of reset cells and reset cathode 62, to which it supplies excited particles. The A.C. keep-alive electrode 140 is covered by the insulating layers 120 and 132. In this keep-alive arrangement, the plate 86 is provided with a slot 142, and plate 80 is provided with a column of holes 150. The slot 142 overlies and is aligned with the column of holes 150, and both lie beneath and are aligned with the A.C. electrode 140 so that, in effect, the electrode 140, slot 142 and holes 150 form a sandwich. The slot 142 in the plate 86 is narrower than the opaque A.C. electrode 140 so that a viewer, looking through face plate 30, cannot see any glow which is present in slot 142 and holes 150. Electrode 140 operates with plate 80 to produce glow discharge between them and produce excited particles in slot 142 and holes 150. These excited particles are available to the reset cathode 62 and assist the firing of the column of reset cells.

Systems for operating panel 10 are described in U.S. Pat. No. 4,386,348 and in U.S. Pat. No. 4,315,259, of Joseph E. McKee and James Y. Lee, which is also incorporated herein by reference. Some of the principles of these systems are useful in the system described below.

Figure 3:
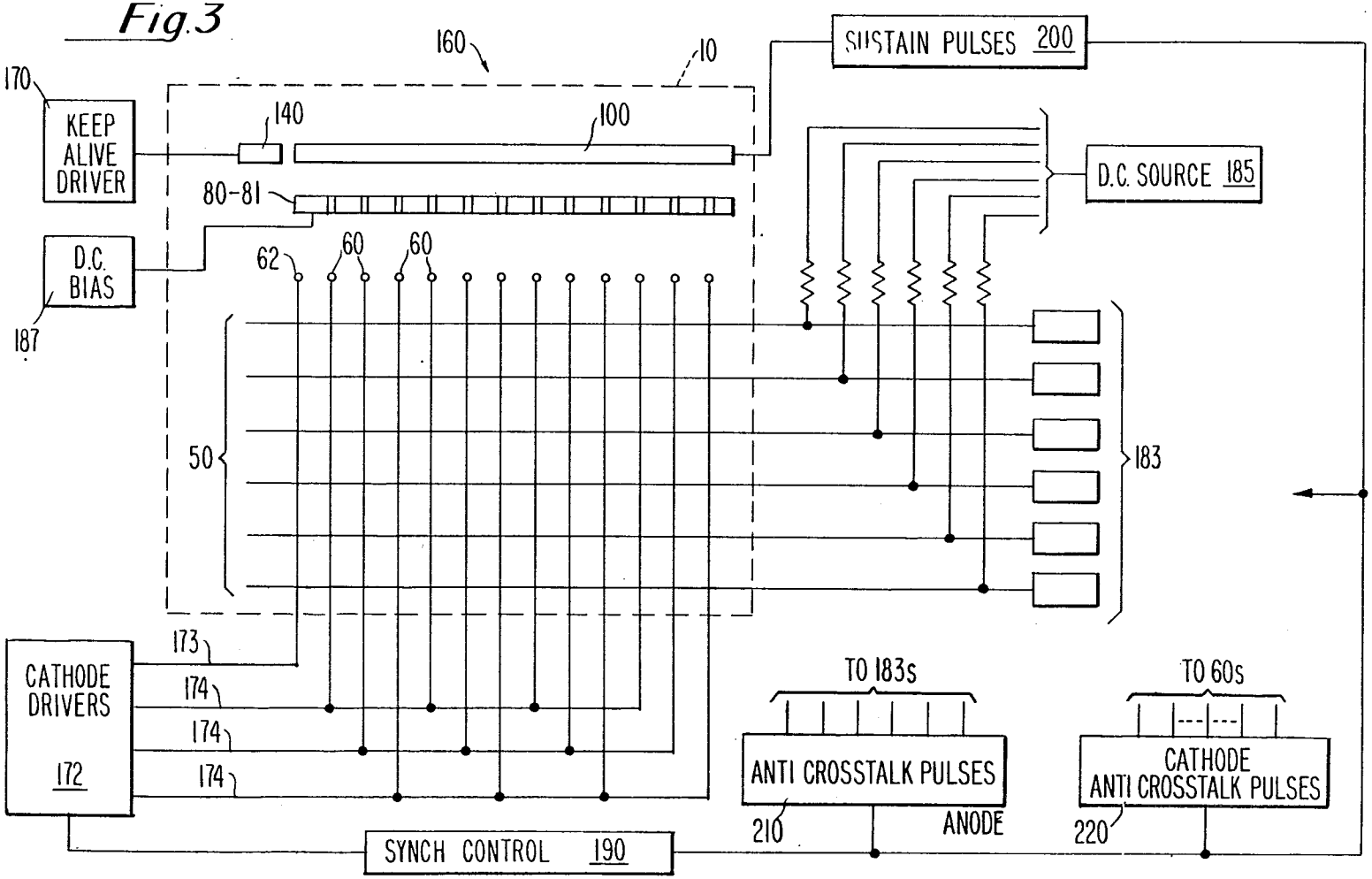
FIG. 3 is a schematic representation of the panel of FIG. 1 and an electronic system in which it may be operated.

A schematic representation of the display panel 10 and an electronic system 160, according to the invention, for operating the panel are shown in FIG. 3. The circuit includes a keep-alive driver 170, which provides an A.C. signal, suitably coupled to keep-alive electrode 140. The system also includes module 172 which comprises a series of serially energizable drivers for providing a negative reset pulse for reset cathode 62 on lead 173 and a series of negative scan cathode pulses for cathodes 60 on leads 174. The scan cathodes 60 are connected in groups or phases, with each group including any suitable number of cathodes such as three or four or six, or more, as desired. Grouping of cathodes in this way is now well known in the SELF-SCAN panel art. The scan phase drivers in module 172 are sequentially activated so as to energize each of the cathodes 60 in consecutive sequence along the "X" axis of the panel.

A D.C. power source 185 is coupled through a resistive path to each of the scan anodes 50. In addition, separate data drivers 183, each of which represents a source of write pulses and erase pulses, are coupled, one to each scan/address anode 50.

A source 187 of D.C. bias potential is coupled to priming plate 80, and a source 200 of A.C. sustainer signals, is connected to the transparent conductive layer 100.

Suitable timing and synchronising circuits 190 are provided as required.

The operation of display panel 10, as described in the above-identified application is generally as follows. With the keep-alive mechanism energized by source 170 and generating excited particles, and with operating potential applied to the scan anodes 50 from source 185, the reset cathode 62 is energized to fire the column of reset cells, and then the scan cathodes 60 are energized sequentially by operation of driver module 172 to carry out a scanning operation in the D.C. scan portion and scan cells 76 of the panel 10. At the same time, with A.C. sustaining pulses applied from source 200 to the electrode 100, at each column of scan cells is energized, negative write or display pulses are applied from one or more selected driver modules 183, in accordance with input data and with proper timing with respect to the sustaining pulses, to the selected scan anodes to interrupt current flow in the scan cells defined by these selected scan anodes. This interplay of signals and interruption of scan current causes the formation of positive column discharge through apertures 92 into the associated display cells 94 to cause glow to develop in these associated display cells 94 where it is sustained by the sustaining pulses. When all of the columns of scan cells 76 have been energized and the appropriate associated display cells have been energized, a sustained message is present and visible in the upper display portion of the panel, and the scanning section of the panel may be made inactive.

Under some circumstances in the foregoing operating cycle, when negative write or erase signals are applied to selected anodes, these applied signals are coupled to adjacent non-selected anodes, and spurious glow occurs in non-selected display cells, usually previously ionized cells.

Figure 4:
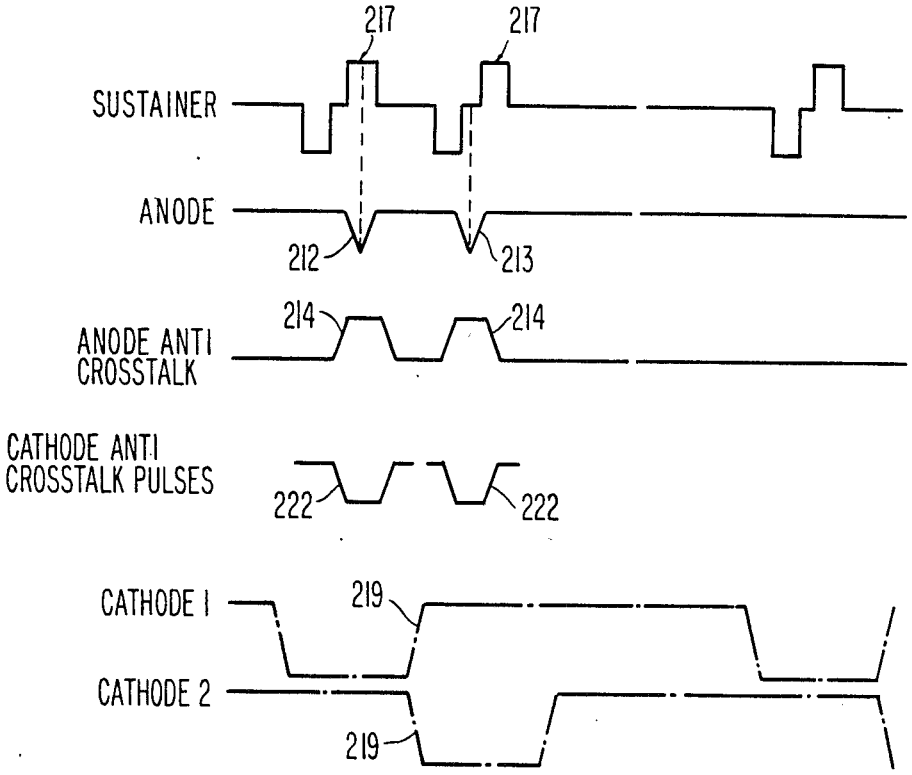
FIG. 4 is a representation of some waveforms used in operation of the system of the invention.

One arrangement for preventing crosstalk in panel 10 is described and claimed in U.S. Pat. No. 4,373,157 and comprises providing a source 210 of generally positive pulses 214 (FIGS. 3 and 4) coupled to all of the anode drivers 183. As each column of scan/address cells is turned on and one or more anodes 50 is energized by a negative write or erase pulse 212 or 213 (FIG. 4) from its data driver 183 to cause the associated display cells to turn on and glow or be erased, a pulse 212 from source 210 is also applied to all of the scan/display anodes, including the selected anode. However, the negative write pulse 212 overcomes the effect of the positive anti-crosstalk pulse 214 to achieve the desired turn-on of the selected display cell or cells.

This preventive operation applied to the non-selected scan anodes prevents these anodes from being reduced to such a negative potential that glow is transferred to the associated selected display cells.

The pulses 214 applied by the crosstalk prevention circuit 210 are generally positive pulses which have an amplitude of about 60 volts, and they start, perhaps 100 nanoseconds, before the start of a write pulse 212, which may be about 150 volts negative. The pulses 214 also decay to zero slowly after the termination of a write pulse. The time duration may be about two or three microseconds. The waveforms shown in FIG. 4 also include the sustainer signals 217 which are applied to electrode 100 and a write pulse 212 and an erase pulse 213. Pulses 212 and 213 are substantially identical, but whether they write or erase is determined by their relationship to the sustainer signals. The anti-crosstalk pulses 214 which accompany a write or erase pulse are shown. Two voltage waveforms 219 which are applied to two adjacent cathodes to turn on two adjacent columns of scan/address cells are shown. The number of such cathode pulses applied is determined by the number of groups of cathodes in the panel 10.

Under some circumstances, other or additional precautions can be taken to prevent crosstalk. In this case, the cathodes 60 are manipulated by themselves or along with the anodes as described above. According to the invention, this action comprises providing a source 220 of generally negative pulses 222 (FIGS. 3 and 4) which are applied to all of the cathodes 60 except the cathode which is to be turned on in the scanning cycle. The cathode compensation pulse 222 shown has a time duration greater than the write or erase pulse 212 or 213, and its negative excursion starts before the write or erase pulse and goes to ground potential from normal off-cathode bias. Pulse 222 also terminates after the write or erase pulse.

The theory of operation of this cathode compensation operation is that the "on" cathode is at a relatively low potential, about ground, and the other "off" cathodes are at a somewhat higher potential, say +80 volts. The priming plate 80 is at an even higher potential, say +115 volts, so that electrons at an "on" cathode might be attracted to other cathodes which are "off" and to adjacent portions of the priming plate and might enter the other non-selected display cells and thus cause spurious display glow. The anti-crosstalk pulses 220, which overlap write pulses 212, focus the electrons back to and retain them at the "on" cathode so that the desired selected display cells are turned on, rather than unselected cells.

What is claimed is:

1. A display panel and operating system therefor comprising a gas-filled display panel including a matrix of D.C. scanning cells arrayed in columns and having scan electrode means for turning on all of the cells of each column sequentially and for selectively turning off one or more scan cells in each column as the column is turned on; and a matrix of display cells adjacent to said matrix of scanning cells, with each scanning cell communicating with a display cell through a small aperture in an electrode plate, and having display electrode means for operation to sustain display glow after glow has been transferred thereto from a scanning cell, a source of sustaining signals coupled to said display electrode means, a source of display signals coupled to said scanning electrode means and operable to turn off selected scanning cells in each column of scanning cells as each such column is energized whereby glow is transferred from said selected scanning cells to the associated display cells, said scan electrode means including an array of row anodes and an array of column cathodes which cross each other and define said scanning cells, a first source of anti-crosstalk signals coupled to said scan anodes for application of anti-crosstalk signals thereto at the same time that display signals are coupled thereto, and a second source of anti-crosstalk signals coupled to said scan cathodes for application of anti-crosstalk signals to the "off" cathodes at the same time that display signals are coupled to the "on" cathodes in a scanning cycle, scan cathodes which are associated with scan cells which are turned on and glowing being "on" cathodes and scan cathodes which are associated with scan cells which are not glowing being "off" cathodes, scan cells which are "on" generating excited particles, said first and second anti-crosstalk signals serving to focus and retain excited particles at "on" scan cells and thus assist the turn-on of the display cells associated with "on" scan cells.

2. The system defined in claim 1 wherein said display signals are negative pulses and said first anti-crosstalk signals are positive pulses, and said second anti-crosstalk signals are negative pulses which are negative-going from off-cathode bias potential.

3. The system defined in claim 1 wherein said display signals are negative signals, said first anti-crosstalk signals are positive pulses, and said second anti-crosstalk signals are negative pulses which are negative-going from off-cathode bias potential and have a time duration greater than that of said display signals and they operate to confine the display operation to the selected "on" cathode which receives a display signal.

4. A display panel and operating system therefor comprising a gas-filled display panel including a matrix of D.C. scanning cells arrayed in rows and columns and having a scan/address anode in operative relation with each row of scanning cells and a scan cathode in operative relation with each column of scanning cells, means for turning on all of the scanning cells of each column of scanning cells sequentially and for selectively turning off one or more scanning cells in each column as the column is turned on; and a matrix of display cells adjacent to said matrix of scanning cells, with each scanning cell communicating with a display cell through a small aperture in an electrode plate, and having display electrode means for operation to sustain display glow in a display cell after glow has been transferred thereto from a scanning cell, a source of sustaining signals coupled to said display electrode means, a separate source of display signals coupled to each said scan/address anode, each source being operable to turn off the scanning cells in each column of scanning cells with which its anode is associated as each such column is energized whereby glow is transferred from turned off scanning cells to the associated display cells, a first source of anti-crosstalk signals coupled to said scan/address anode means for application thereto at the same time that display signals are coupled thereto, and a second source of anti-crosstalk signals coupled to said scan cathodes for application of anti-crosstalk signals to the "off" cathodes at the same time that display signals are coupled to the "on" cathodes in a scanning cycle, the "off" cathodes being the cathodes associated with cells which are not turned on and the "on" cathodes being the cathodes which are associated with cells which are turned on and glow, "off" cathodes being associated with scan cells which are off and not glowing and "on" cathodes being associated with scan cells which are are turned on and glowing, wherein said anti-crosstalk signals operate to confine the display operation to the selected "on" cathode which receives a display signal.

5. The system defined in claim 4 wherein said display signals are negative pulses and said first anti-crosstalk signals are positive pulses, and said second anti-crosstalk signals are negative pulses which are negative-going from off-cathode bias potential.

6. The system defined in claim 5 wherein said second anti-crosstalk signals have a time duration greater than that of said display signals.

7. A display panel and operting system therefor comprising a gas-filled display panel including a matrix of D.C. scanning cells arrayed in columns and having scan electrode means for turning on all of the cells of each column sequentially and for selectively turning off one or more scan cells in each column as the column is turned on; and a matrix of display cells adjacent to said matrix of scanning cells, with each scanning cell communicating with a display cell through a small aperture in an electrode plate, and having display electrode means for operation to sustain display glow after glow has been transferred thereto from a scanning cell, a source of sustaining signals coupled to said display electrode means, a source of display signals coupled to said scanning electrode means and operable to turn off selected scanning cells in each column of scanning cells as each such column is energized whereby glow is transferred from said selected scanning cells to the associated display cells, said scan electrode means including an array of row anodes and an array of column cathodes which cross each other and define said scanning cells, and a source of anti-crosstalk signals coupled to said scan cathodes for application of anti-crosstalk signals to the "off" cathodes at the same time that display signals are coupled to the "on" cathodes in a scanning cycle, the "on" cathodes being cathodes which are associated with cells which are turned on and glowing and "off" cathodes being cathodes which are associated with cells which are in the off state and not glowing, wherein said display signals are negative pulses, and said anti-crosstalk signals are negative pulses which are negative-going from off-cathode bias potential and they operate to confine the display operation to the selected "on" cathode which receives a display signal.

8. The system defined in claim 7 wherein said anti-crosstalk signals have a time duration greater than that of said display signals.

9. A display panel and operating system therefor comprising a gas-filled display panel including a matrix of D.C. scanning cells arrayed in columns and having scan electrode means for turning on all of the cells of each column sequentially and for selectively turning off one or more scan cells in each column as the column is turned on; and a matrix of display cells adjacent to said matrix of scanning cells, with each scanning cell communicating with a display cell through a small aperture in an electrode plate, and having display electrode means for operation to sustain display glow after glow has been transferred thereto from a scanning cell, a source of sustaining signals coupled to said display electrode means, a source of display signals coupled to said scanning electrode means and operable to turn off selected scanning cells in each column of scanning cells as each such column is energized whereby glow is transferred from said selected scanning cells to the associated display cells, said scan electrode means including an array of row anodes and an array of column cathodes which cross each other and define said scanning cells, a first source of anti-crosstalk signals coupled to said scan anodes for application of signals thereto at the same time that display signals are coupled thereto, and a second source of anti-crosstalk signals coupled to said scan cathodes for application of signals to the "off" cathodes at the same time that display signals are coupled to the "on" cathodes in a scanning cycle, said display signals being generally negative pulses and said first anti-crosstalk signals being generally positive pulses, and said second anti-crosstalk signals being generally negative pulses, the "off" cathodes being associated with scan cells which are off and not glowing and "on" cathodes being associated with scan cells which are turned on and glowing, wherein said second anti-crosstalk signals operate to confine the display operation to the selected "on" cathode which receives a display signal.

10. The system defined in claim 9 wherein said second anti-crosstalk signals are of greater time duration than said display signals.

11. A display panel and operating system therefor comprising a gas-filled display panel including a matrix of D.C. scanning cells arrayed in rows and columns and having a scan/address anode in operative relation with each row of scanning cells and a scan cathode in operative relation with each column of scanning cells, means for turning on all of the scanning cells of each column of scanning cells sequentially and for selectively turning off one or more scanning cells in each column as the column is turned on; and a matrix of display cells adjacent to said matrix of scanning cells, with each scanning cell communicating with a display cell through a small aperture in an electrode plate, and having display electrode means for operation to sustain display glow in a display cell after glow has been transferred thereto from a scanning cell, a source of sustaining signals coupled to said display electrode means, a separate source of display signals coupled to each said scan/address anode, each source being operable to turn off the scanning cells in each column of scanning cells with which its anode is associated as each such column is energized whereby glow is transferred from turned off scanning cells to the associated display cells, a first source of anti-crosstalk signals coupled to said scan/address anode means for application thereto at the same time that display signals are coupled thereto, and a second source of anti-crosstalk signals coupled to said scan cathodes for application of signals to the "off" cathodes at the same time that display signals are coupled to the "on" cathodes in a scanning cycle, said display signals being generally negative pulses and said first anti-crosstalk signals being generally positive pulses, and said second anti-crosstalk signals being generally negative pulses, said anti-crosstalk signals acting to confine the display operation to the selected "on" cathode which receives a display signal.

12. The system defined in claim 11 wherein said second anti-crosstalk signals have a time duration greater than that of said display signals.

13. A display panel and operating system therefor comprising a gas-filled display panel including a matrix of D.C. scanning cells arrayed in columns and having scan electrode means for turning on all of the cells of each column sequentially and for selectively turning off one or more scan cells in each column as the column is turned on; and a matrix of display cells adjacent to said matrix of scanning cells, with each scanning cell communicating with a display cell through a small aperture in an electrode plate, and having display electrode means for operation to sustain display glow after glow has been transferred thereto from a scanning cell, a source of sustaining signals coupled to said display electrode means, a source of display signals coupled to said scanning electrode means and operable to turn off selected scanning cells in each column of scanning cells as each such column is energized whereby glow is transferred from said selected scanning cells to the associated display cells, said scan electrode means including an array of row anodes and an array of column cathodes which cross each other and define said scanning cells, and a source of anti-crosstalk signals coupled to said scan cathodes for application of signals to the "off" cathodes at the same time that display signals are coupled to the "on" cathodes in a scanning cycle, said anti-crosstalk signals being generally negative pulses having a time duration greater than that of said display signals and acting to confine the display operation to the selected "on" cathode which receives a display signal.

* * * * *